US007025916B2

(12) United States Patent
Bachrach

(10) Patent No.: US 7,025,916 B2
(45) Date of Patent: Apr. 11, 2006

(54) PROCESS OF MAKING BIOENGINEERED COLLAGEN FIBRILS

(75) Inventor: Nathaniel Bachrach, Passaic, NJ (US)

(73) Assignee: Organogenesis, Inc., Canton, MA (US)

( * ) Notice: Subject to any disclaimer, the term of this patent is extended or adjusted under 35 U.S.C. 154(b) by 130 days.

(21) Appl. No.: 10/447,123

(22) Filed: May 28, 2003

(65) Prior Publication Data

US 2003/0205839 A1 Nov. 6, 2003

Related U.S. Application Data

(62) Division of application No. 09/672,722, filed on Sep. 28, 2000, now Pat. No. 6,592,794.

(60) Provisional application No. 60/156,444, filed on Sep. 28, 1999.

(51) Int. Cl.
*B01D 37/00* (2006.01)
*D01D 5/06* (2006.01)
*D01F 4/00* (2006.01)

(52) U.S. Cl. ..... 264/169; 210/768; 210/787; 210/788; 210/800; 264/178 F; 264/183; 264/202

(58) Field of Classification Search ..... 264/169, 264/178 F, 183, 202; 210/768, 787, 788, 210/800
See application file for complete search history.

(56) References Cited

U.S. PATENT DOCUMENTS

| | | | | |
|---|---|---|---|---|
| 3,949,073 | A | 4/1976 | Daniels et al. | 424/177 |
| 4,331,766 | A | 5/1982 | Becker et al. | 435/273 |
| 4,582,640 | A | 4/1986 | Smestad et al. | 260/123 |
| 4,642,117 | A | 2/1987 | Nguyen et al. | |
| 4,702,876 | A | 10/1987 | Ebregt et al. | |
| 4,703,108 | A | 10/1987 | Silver et al. | |
| 4,803,075 | A | 2/1989 | Wallace et al. | |
| 5,106,949 | A | 4/1992 | Kemp et al. | |
| 5,256,418 | A | 10/1993 | Kemp et al. | |
| 5,378,469 | A | 1/1995 | Kemp et al. | |
| 5,460,962 | A | 10/1995 | Kemp | 435/238 |
| 5,475,052 | A | 12/1995 | Rhee et al. | |
| 5,997,896 | A | 12/1999 | Carr, Jr. et al. | |

FOREIGN PATENT DOCUMENTS

| | | | |
|---|---|---|---|
| EP | 0 284 789 | A1 | 10/1988 |
| JP | 61-226052 | A | 10/1986 |
| JP | 64-061506 | A | 3/1989 |
| JP | 03-170571 | A | 7/1991 |
| JP | 7-500037 | A | 1/1995 |
| WO | 94/01483 | A1 | 1/1994 |
| WO | 94/03119 | A1 | 2/1994 |
| WO | 95/31473 | A1 | 11/1995 |

(Continued)

OTHER PUBLICATIONS

Garg, et al., "Reconstituted Collagen Fibers: Effect of Proteoglycans", IEEE, 1988, pp. 84-87.

(Continued)

*Primary Examiner*—Leo B. Tentoni
(74) *Attorney, Agent, or Firm*—Kramer Levin Naftalis & Frankel LLP

(57) ABSTRACT

The invention is directed to a class of fiber or strand suspension compositions that may be processed further into viscoelastic pastes or porous solids. The preferred compositions of the invention comprise biologically derived or biologically compatible materials, such as collagen, that can be injected or implanted for tissue augmentation or repair. This invention is also directed to methods of making these compositions and to apparatus that can be used to make the compositions.

15 Claims, 11 Drawing Sheets

FOREIGN PATENT DOCUMENTS

WO 96/40216 A1 12/1996

OTHER PUBLICATIONS

Kato, et al., "Formulation of Continuous Collagen Fibres: Evaluation of Biocompatibility and Mechanical Properties", Biomaterials, 1990, vol. 11, 169-175.

Klingman, et al., "Histologic Response to Intradermal Zyderm and Zyplast (Glutaraldehyde Cross-Linked) Collagen in Humans", J. Dermatol. Surg. Oncol., vol. 12:4, Apr. 1986, pp. 351-357.

Knapp, et al., "Behavior of Solubilized Collagen as a Bioimplant", Journal of Surgical Research, vol. 23:2, pp. 96-105.

PROCESS OF MAKING BIOENGINEERED COLLAGEN FIBRILS

CROSS-REFERENCE TO RELATED APPLICATIONS

This application is a divisional of application Ser. No. 09/672,722, now U.S. Pat. No. 6,592,794, filed Sep. 28, 2000, which claims the benefit of provisional application Ser. No. 60/156,444, filed Sep. 28, 1999.

FIELD OF THE INVENTION

The invention relates to a class of fiber or strand suspension compositions, including methods and apparatus for producing such compositions. The compositions may be processed further into viscoelastic pastes or porous solids. Preferred compositions of the invention comprise biologically derived or biologically compatible materials, such as collagen that can be injected or implanted for tissue augmentation or repair.

BACKGROUND OF THE INVENTION

Collagen is the principal structural protein in the body and constitutes approximately one-third of the total body protein. It comprises most of the organic matter of the skin, tendons, bones and teeth and occurs as fibrous inclusions in most other body structures. Some of the properties of collagen are its high tensile strength; its ion exchanging ability, due in part to the binding of electrolytes, metabolites and drugs; its low antigenicity, due to masking of potential antigenic determinants by the helical structure, and its low extensibility, semipermeability, and solubility. Furthermore collagen is a natural substance for cell adhesion. These properties make this protein suitable for fabrication of bioremodelable research products and medical devices such as implantable prostheses, cell growth substrates, and cellular and acellular tissue constructs.

Collagen compositions are typically prepared from skin or tendons by dispersion, digestion or dissolution, or a combination thereof, of the native tissue collagen. Dispersion involves mechanically shearing the tissue to produce a suspension of collagen fibers. Digestion involves enzyme degradation of the non-helical telopeptide portions of the collagen molecule, resulting in a solution of atelopeptide collagen. Dissolution involves cleavage of acid labile crosslinks in newly formed collagen fibers resulting in a solution of collagen monomers and polymers using procedures involving acid or enzyme extraction. Enzyme extraction is preferable in many instances because its methodology produces increased yield and higher purity collagen. However enzyme extraction suffers the disadvantage of producing partially degraded collagen, i.e., the extraction enzymes cleave the collagen molecule at the terminal non-helical regions which contain the inter-molecular cross-linkages.

Injectable formulations have been used in the art as tissue bulking compositions, particularly in urology and plastic surgery. Upon implantation to a patient, however, the volume persistence of previous implants decreases partly due to the absorption of the aqueous carrier by the body and partly due to the low concentration of the collagen. Follow up or "top-off" injections at the site are usually necessary with previously developed collagen compositions because the volume decreases due to the absorption of liquid component of the composition by the body. Therefor, volume persistence and shape persistence are desired of an injectable collagen implant. Higher concentrations of collagen helps to maintain volume persistence, but at the same time decreases extrudability and intrudability of the composition through a needle and into the patient's tissue.

Besides volume persistence, shape persistence is desired of the injectable collagen compositions known in the art. When injected, the collagen tends to migrate through the tissue; therefore, if specific and local tissue augmentation or bulking is required, such migration would necessitate subsequent injections.

The present invention describes a collagen composition in the form of bioengineered collagen fibers, apparatus methods for making bioengineered collagen fibers and their use as an injectable collagen composition that overcomes the drawbacks of injectable collagen compositions known in the art. Other preferred embodiments directed to bioengineered collagen fibers formed into a matrix substrate for cell culture and a composition comprising compacted fibers for surgical implantation are also disclosed.

SUMMARY OF THE INVENTION

The invention provides bioengineered collagen fibers and injectable collagen compositions comprising bioengineered collagen fibers and apparatus and methods for making and using such bioengineered collagen fibers.

The present invention provides injectable collagen compositions having improved properties over known injectable collagen compositions in the art. Preferred injectable collagen compositions prepared in accordance to the present invention have a high concentration of collagen. The injectable compositions are useful for tissue augmentation, tissue repair and drug delivery. The bioengineered collagen fiber compositions may be used to make a matrix substrate for cell culture or a solid compacted matrix of fibers for implantation. The bioengineered collagen fiber compositions have improved characteristics for bioremodeling compared to other known compositions.

DETAILED DESCRIPTION OF THE INVENTION

Figure 1:
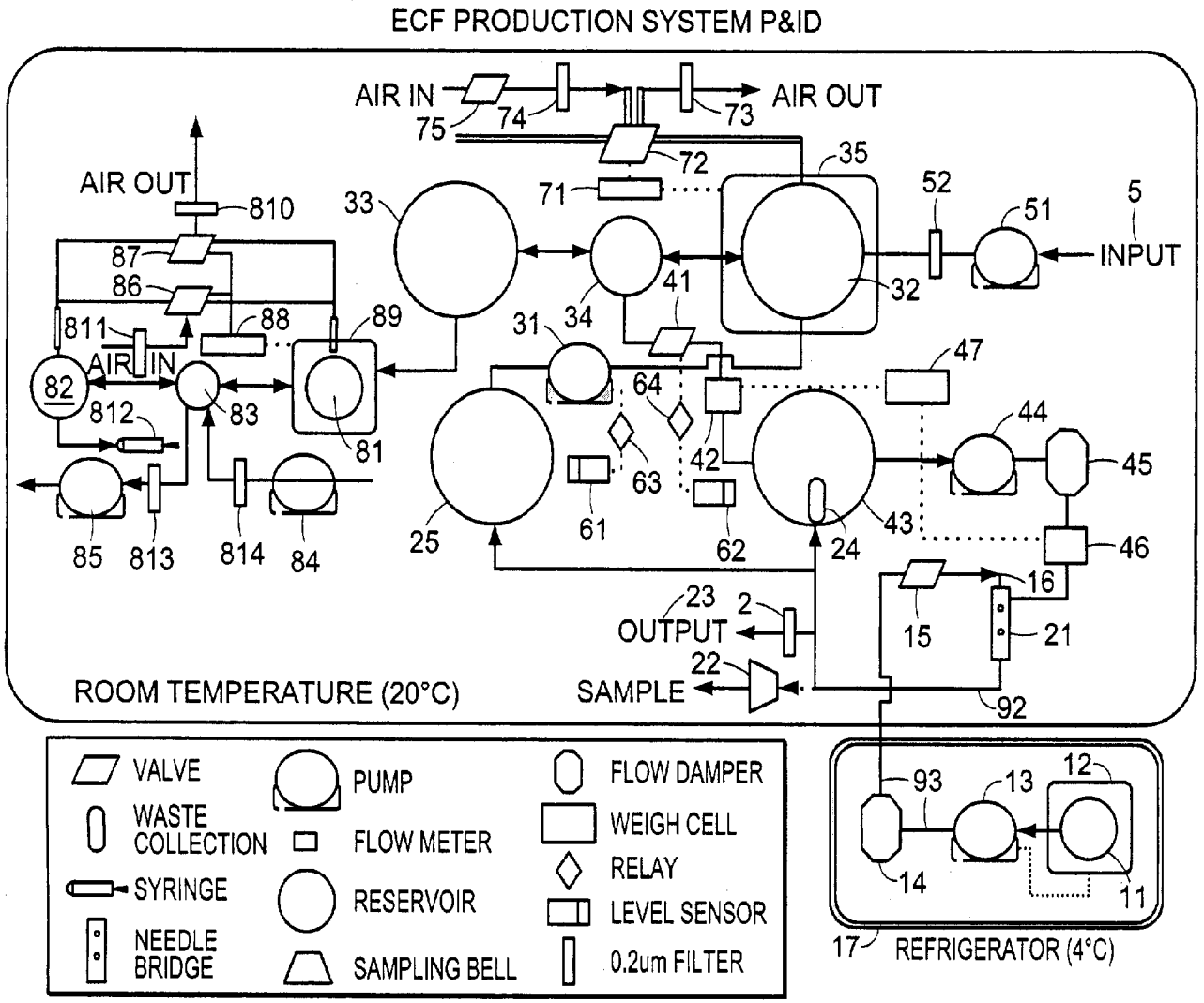
FIG. 1 is a schematic representation of one apparatus for use in the methods to produce reconstituted collagen strands.

The invention is directed to fibers or strands formed from viscous or viscoelastic materials, methods for the production of such fibers or strands formed from viscous or viscoelastic materials, compositions formed therefrom, and uses therefor.

There are no limitations on the starting materials that are used to produce the strands except that they be extrudable and be able to be induced to become sufficiently solid by some means after extrusion into a coagulation agent so that the extruded strand shape is maintained. The method for producing the composition of the invention comprises a means for extruding a material through an orifice into a coagulation agent to form strands from the material; a filtration means to remove the strands from the coagulation agent; and, optionally, a concentration means for concentrating the strands produced. The method for producing these strands is repeatable and scalable, and may be performed in a closed system to maintain aseptic processing conditions.

In the method of the invention, material is passed through and reformed by an orifice that determines the dimension and shape of the strands produced. The size and shape of the orifice may be changed to alter the shape of the strands. Upon extrusion of the material from the orifice, the material is contacted with a coagulation agent that causes the material to solidify, or at least become partially solid as compared to its state prior to contacting the agent. Preferably, the coagulation agent and the extruded material are generally immiscible. There are two fundamental approaches to extrusion production of the strands of the present invention: a one step extrusion method and a two step extrusion method.

In the one step extrusion method, the material is extruded from an orifice submerged in a stream of a flowing coagulation agent so that liquid breakup of the extruded stream occurs. In other words, material is introduced from the orifice, extending therefrom for a length, until the shear forces of the flowing coagulation agent around it cause the strand to break at the point near the orifice opening that is in contact with the stream. The length of the forming strand at the point of liquid breakup can be modulated by varying the different flow rates and flow characteristics of both the material and the coagulation agent to vary the resultant length and shape of the strands. The skilled artisan can determine and accomplish alterations to the production configurations by manipulating any one or more of the aforementioned parameters in this process to produce the strand material of the invention. The process is preferably carried out when the properties of the extruded material result in a cross-sectional shape and size similar to the extrusion orifice. Coagulation or solidification of the extruded material takes place in that strand form so that its formed shape is maintained as it is carried downstream in the coagulation agent.

In the two-step extrusion method the material is first extruded into a gaseous environment to form droplets of material due to surface tension of the material. Droplet size is determined and controlled by the orifice size, shearing gas flow, flow perturbations, or other methods available to those skilled in the art. While the droplets of material are still solidifying, they are passed though a second orifice into the coagulation agent to create the strand shape. In that shape coagulation is completed and the strand shape is retained in the final strand form. After the coagulation agent has acted on the extruded starting material to form a strand, the formed strand is filtered from the coagulation agent.

Filtration of the formed strands from the coagulation agent to collect the formed strands during production is generally desirable in the production method. Filtration means include, but are not limited to: standard macrofiltration, techniques and apparatus, such as flat bed vacuum filtration, dead end filtration, and by other techniques known in the art of filtration. In the one-step method, where high flow rates of coagulation buffer are used to effect the shearing formation of the strand shape, continuous tangential flow filtration is a preferred means of filtration. In the two-step process the shearing is effected by gas flow or extrusion rate alone, therefore continuous tangential flow filtration or other filtration methods may be employed. Tangential flow filtration requires continuous pumping of the strand material within the coagulation agent through the bore of the filter in the filtration loop to avoid caking and clogging the filter. Because strands in this invention are generally shear sensitive and would easily become entangled in pumping equipment and standard valves, the method includes an effective filtration technique to filter the coagulation agent from the strands using hydrostatic pressure as the driving force and a unique valve configuration to allow virtually continuous flow of the coagulation agent. This technique is not the only way to accommodate filtration, but is the preferred filtration method for use in the production method of the invention.

After the production and filtration of an amount of strands has been completed, they are then collected or concentrated to form paste compositions or other materials. In the concentration step, any one or number of concentration means, techniques, and apparatus can be employed, such as: centrifugation, flatbed filtration, gravity sedimentation, or other techniques known in the art of concentration. In some cases it may be desirable to use more than one concentration method in a multi-step concentration process. In the preferred method a second tangential flow filtration scheme is used to provide uniform concentrations and aseptic continuous processing adjacent to the production loop.

In a more preferred embodiment, the strands formed from collagen solutions are bioengineered collagen fibers that have an elongated, and substantially cylindrical shape. In a more preferred method, the invention is directed to a method for producing collagen fiber compositions for use in medicine and surgery. The method of the invention is particularly adaptable for producing compositions comprising strands of biomaterial comprising extracellular matrix components such as collagen or hyaluronic acid or mixtures thereof and for biocompatable materials such as poly-glycolic acid (PGA) or poly-lactic acid (PLA). As collagen is a more preferred starting material for the production of extruded strands, the method described below is the preferred method for producing collagen strands from a solution comprising collagen. In a most preferred method of the invention, a closed flow system is employed in order to facilitate aseptic production of the collagen strands.

In the more preferred method, collagen strands are made by the method comprising: extruding a solution containing collagen into a coagulation agent that comprises either a dehydration or a pH neutralizing agent, or both; allowing or inducing the extruded collagen to form a discrete unitary segment or strand having an elongated and somewhat cylindrical shape; allowing or inducing the collagen to dehydrate or neutralize to solidify to form a strand; and collecting the formed strands from the coagulation agent using a filtration means.

In an even more preferred method, an acidic collagen solution is dispensed from a containing reservoir using a fluid pumping means through an orifice disposed and immersed in the flow of a coagulation agent to contact the collagen solution with the coagulation agent. The collagen is extruded at a rate so that a continuous mass of collagen emerges, extends and elongates from the orifice that is then allowed or caused to break or be shorn away from the orifice by the coagulant flow to produce a discrete unitary segment or mass of collagen. As the contact with the coagulation agent occurs, the acidic collagen solution becomes neutralized or undergoes some degree of dehydration, or both, causing the solubilized collagen molecules to precipitate and become fibrillar within a unitary, cohesive strand of collagen. By the precipitation and fibril formation, the collagen solidifies to become a dehydrated viscoelastic solid strand of collagen, a bioengineered collagen fiber. After the strand has shorn from the orifice and is carried by the flowing coagulation agent, the collagen strand continues to form and solidify until it is collected by the filtration apparatus until it is rinsed of coagulation agent. The method for reducing the strands to a final usable product includes the concentration of the collagen strands but any preferred concentration method ultimately depends on the qualities of the material desired in its final form. The final product may resemble a paste form or the material may be processed further into a solid form to produce other usable constructs. In some preferred methods the strands may be lyophilized, that is, freeze-dried, to remove water from the strand composition, either prior to or after any degree of concentration. In other preferred methods, the collagen strands are compacted to remove excess liquid from the strands to produce a dense fibrillar collagen matrix.

Engineered collagen fibers may then be terminally sterilized using means known in the art of medical device sterilization. A preferred method for sterilization is by contacting the fibers with sterile 0.1% peracetic acid (PA) treatment neutralized with a sufficient amount of 10 N sodium hydroxide (NaOH), according to U.S. Pat. No. 5,460,962, the disclosure of which is incorporated herein by reference. Decontamination is performed in the concentration loop, in a sterilization loop integrated with the apparatus, or in a separate container for up to about 24 hours. Fibers are then rinsed by contacting them with three volumes of sterile water for 10 minutes each rinse. Another preferred sterilization means is by gamma irradiation. Collagen strands are packaged in syringes, bags, or other containers made from material suitable for gamma irradiation between 25.0 and 35.0 kGy. Still another preferred sterilization means is electron-beam, or "e-beam", sterilization where the collagen strand product is subjected to a beam of electrons to inactivate any microorganisms present.

Collagen for use in the present invention may be obtained from any suitable source, typically skin and tendons. Many procedures for obtaining and purifying collagen, typically involving acid or enzyme extraction, are known to practitioners in the art and may be used to prepare collagen for use in the present invention. Collagen obtained using acid extraction methods is more preferable over enzyme extraction methods such as by pepsin extraction as the non-helical telopeptide regions are maintained in the collagen molecule when acid extraction methods are used. While not wishing to be bound by theory, it is believed that the telopeptide regions play an integral role in collagen fibrillogenesis and the fibrillar nature of collagen composition of the invention is desirable. A preferred collagen composition for use in the present invention is acid extracted bovine tendon collagen, disclosed in U.S. Pat. No. 5,106,949, incorporated herein by reference. However, atelopeptide collagen may be desirable due to its lower antigenicity and its widespread use in certain medical techniques. Collagen solutions comprising collagen for making collagen thread segments by the methods described herein are generally at a concentration preferably between about 1 mg/ml to about 10 mg/ml, more preferably from about 2 mg/ml to about 6 mg/ml, most preferably from about 4.5 to about 5.5 mg/mil for telopeptide collagen and between about 2.0 to about 4.0 mg/ml, more preferably between about 2.5 to about 3.5 mg/ml for atelopeptide collagen. The preferred pH for the collagen solution is a pH of about 2 to about 4. A preferred solvent for the collagen is dilute acetic acid in water at about 0.05 to about 0.1%, more preferably at about 0.05%, pH 3.5. Other dilute acid solvents that can be used are hydrochloric acid, citric acid, and formic acid. Another preferred collagen solution is Vitrogen 100 (obtained from Collagen Corp.), a 3 mg/ml purified solution of pepsin solubilized atelopeptide bovine dermal collagen dissolved in 0.012N HCl (pH 2.0). In atelopeptide collagen, the non-helical terminals are not completely intact and as a result there are less natively cross-banded fibrils in the collagen formulation described herein. The collagen solution may optionally contain substances such as pharmaceuticals; growth factors; hormones; other extracellular matrix components; other collagen types; or genetic material such as vectors or other genetic constructs, or antisense oligonucleotides, or the like, included in the solution. When collagen fiber segments are formed with these substances in the collagen solution, these substances will be incorporated in the segments. The presence of these components in the collagen fibers when implanted will signal patient's cells to draw them to infiltrate the implant area at a preferred rate of infiltration or transform the patient's cells with the vectors so the cells will synthesize therapeutics to aid in the healing or integration of the implant at the implant site.

The coagulation agent is an agent that is capable of solidifying the extruded material to such a degree that strand shape is maintained. A preferred coagulation agent, or coagulant, should be immiscible with the collagen solution and be capable of removing the water from the collagen solution so that the collagen solution is transformed into a concentrated semi-solid mass having a shape predetermined by the orifice. When the collagen concentrates, it becomes more solid and on a molecular level, the collagen molecules are brought into close proximity for fibrillogenesis to occur. A preferred coagulation agent comprises a dehydrating agent having a higher osmotic pressure than that of the collagen solution, preferably at least about 250 mOsm and a preferred pH from about 5 to about 10, and a more preferred pH from about 7 to about 9. The pH of the coagulation agent is maintained using a buffering agent such as phosphate buffer, borate buffer, or citrate buffer. A preferred buffering agent is one that promotes fibrillogenesis of collagen molecules to result in fibrillar collagen strands. The most preferred buffering agent is phosphate buffer. Preferred dehydrating agents include water soluble, neutral, biocompatible polymers such as DEXTRAN® and polyethylene glycol (PEG). Other preferred dehydration agents are isopropyl alcohol and acetone. In the most preferred embodiment, 20% w/v polyethylene glycol, MW 8000 (PEG-8000), in phosphate buffer is used. Polyethylene glycol compositions are available at a range of molecular weights and may be used at varying concentrations for obtaining the composition of the invention.

For the purpose of illustrating preferred embodiments of the invention only, and not for the purpose of limiting the same, the apparatus of the present invention will be illustrated by describing the preparation of collagen strands. FIG. 1 shows a schematic diagram of one form of an apparatus that may be used to produce bioengineered collagen fibers in accordance with the present invention. The apparatus for the production of collagen strands comprises a production element and a filtration element, and may optionally comprise a concentration element. These elements are circuits or loops that may be assembled to form a closed production system to provide aseptic processing of the strand composition.

The process begins in the production loop of the apparatus. Reservoir vessels 33, 34, 25, and 43, are filled with a coagulation agent comprising 20% (w/w) PEG 8000 water with phosphate buffers at inlet port 5, with a peristaltic pump 51, through a filter 52. A 5 mg/ml collagen solution is stored at 4° C. in a refrigerator 17. It is pumped from the collagen reservoir 11, by means of a peristaltic pump 13, controlled by weight 12. It travels through size 16 tubing 93, through the collagen dampener 14, and a safety valve 15, where it is extruded through the needle 16, in needle bridge 21 where the collagen enters the circulating PEG.

The collagen strand emerges and extends from the needle orifice and eventually breaks away from the orifice at a predetermined length by the shear force set by the rate of the circulating PEG, and travels through a length of about 8 feet of size 17 tubing 92, to the sampling bell 22. At the onset, samples are taken to ensure the appropriate sized bioengineered collagen fibers are being produced. While adjustments to the flow are made, the bioengineered collagen fibers are deposited in the waste filter 24. Once the appropriate sized bioengineered collagen fibers are being produced, the stream is diverted to the reservoir vessel 25. As the reservoir vessel fills, the capacitive proximity switch sensor 61, senses the level of the fluid and turns on the pump 31, through relay 63 to send the formed fibers from the production loop to the filtration loop.

Figure 2:
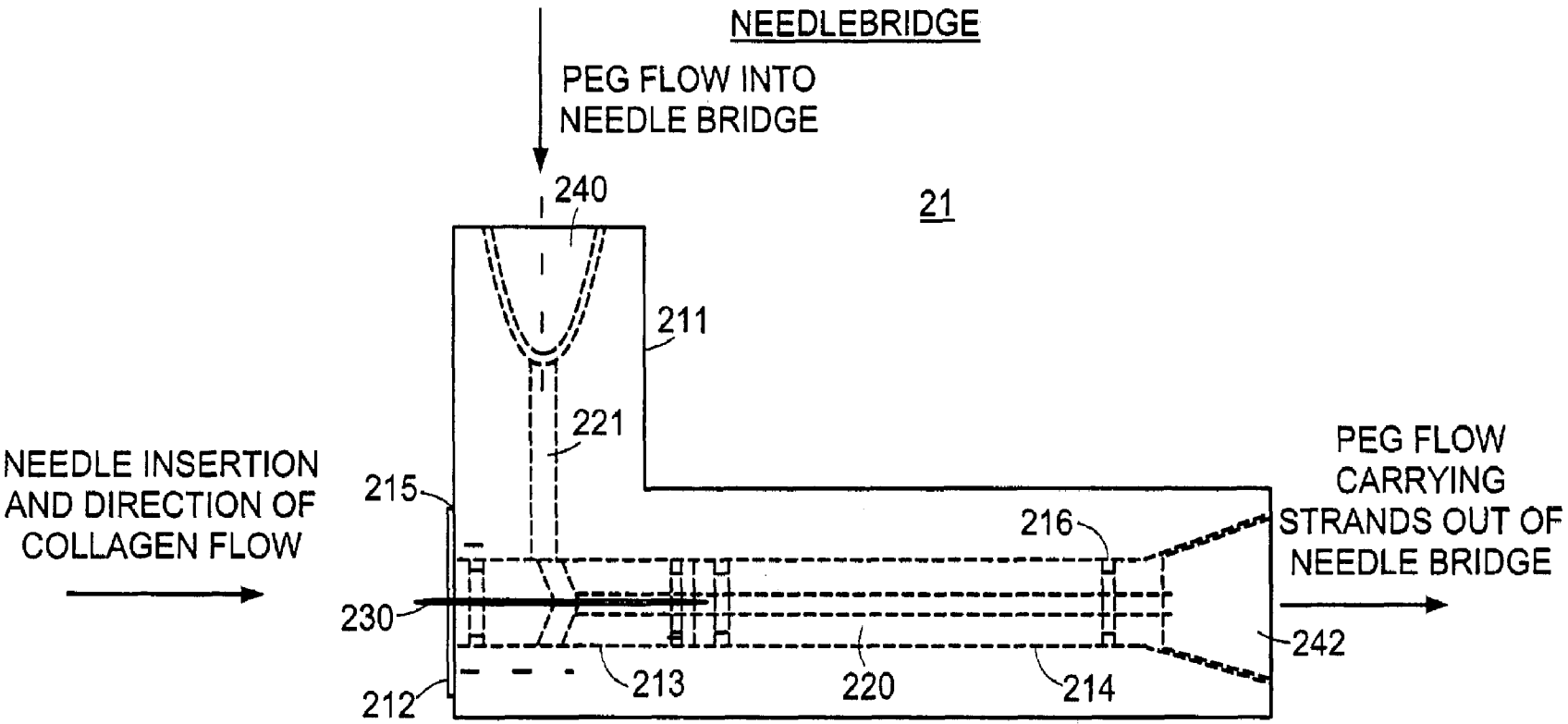
FIG. 2 is a drawing of the preferred embodiment of the needle bridge, used to deliver collagen axially into the center of a flowing PEG stream in a closed system.

The needle bridge 21 is detailed in FIG. 2. In this embodiment, the needle bridge is a coaxial flow system with collagen flowing in the central region and PEG flowing in the annular outer region. The collagen is introduced through a medical grade needle that is inserted, through a sealed silicone gasket, into the center of the PEG flow that would otherwise be Hagen-Poiseuille flow. This is the preferred method for introduction of the collagen into the PEG due to reduced variability and greater flexibility in methods of flow disruption causing strand formation. For example those skilled in the art of liquid jets may facilitate strand formation by axial vibration of the collagen flow either in addition to, or in place of shearing by the coagulation buffer. However, the collagen may be introduced to the flow at any angle as long as the component of collagen velocity in the direction of PEG flow is non-zero.

Specifically, the needle bridge 21 comprises a body 211, a gasket plate 212, a transition plug 213, rubber gasket 215, silicon O-ring gaskets 216, needle 230. The body 211 is made of polycarbonate or other rigid biocompatible material and has an L-shaped cross-section with a first bore 220 communicating both ends of the longer length of the L and a second bore 221 that communicates with the short end of the L and the lumen of the first bore. The needle 230 is inserted into the needle bridge through gasket plate 212 and rubber gasket 215 that seal the needle entry and past the transition plug 213 so that the needle tip is downstream from the juncture of the first and second bores and its length is centered coaxially within the first bore. The needle 230 is preferably blunt but may also be angled and sharp and may be at other angles rather than centrally and coaxially inserted and positioned. The O-ring gasket 216 at the downstream end secures and seals the tubing juncture where the PEG flow carries strands out of the needle bridge at opening 242. PEG flow enters the needle bridge at the opening, travels through the bore 221 turns at the juncture of bore 221 and bore 220 and through bore 220, past needle 230 where collagen emerges at the needle orifice and is shorn off by the flow. The flowing PEG carries the forming collagen fiber out opening 242 to the rest of the processing loop.

Throughout production, the bioengineered collagen fibers are then transferred to the filtration loop to take them out of the production loop. Referring again to FIG. 1, the fibers are pumped to a first filter reservoir 32 to remove it from the production flow. The fibers are exchanged through the filter 34, and a second filter reservoir vessel 33, by means of air pressure. The air enters through port valve 75 and is then filtered in through a filter 74. The pressure valve 72, regulates the switching of the pressure from reservoir 33 to reservoir 32 and is controlled by weight with the weight controller 71, and platform scale 35. As reservoir 32 is pressurized, reservoir 33 is depressurized through a filter 73. As the bioengineered collagen fibers are exchanged, the PEG is recycled from the filter housing 34, to the PEG reservoir 43. The level of the fluid in the PEG reservoir 43, is controlled by a capacitive proximity switch sensor 62, which triggers the relay 64, and opens/closes the valve 41. The flow rate of the effluent is monitored by a flowmeter 42, and collected with a datalogger 47. The PEG is then pumped from the PEG reservoir 43, with a peristaltic pump 44, through a dampener 45, and flow meter 46, and back to the needle bridge 21.

After production is complete, the bioengineered collagen fibers exchange through the filtration system for about 12 hours, while soaking in PEG. They are then concentrated in a 1000 ml volume by allowing effluent flow to continue after production flow has stopped. The strands are rinsed with sterile water (WFI) until the percentage of PEG in the composition is less than about 0.02%. Using filter 52 at input port 5 and filter 2 at output port 23, multiple volume. exchanges of sterile water are pumped through the system. At this point, the formed bioengineered collagen fibers may either be removed from the system for use or further processing outside of the system, or concentrated in a concentration loop integral to the filtration loop.

The collagen strands may be concentrated using the same modified tangential flow filtration method that is employed for filtration. The dilute suspension of strands in water or buffer is pumped from the filtration reservoir into small concentration cylinders. A piston is used to force the strands back and forth from one cylinder to the other through a connecting tangential flow filter. Slow and controlled release of the water or buffer through the filter causes a concentration increase in the collagen strands to the point where the suspension becomes a paste-like composition. The piston can be driven and controlled by air pressure, as described herein, by mechanical means or by other means known in the art.

The bioengineered collagen fibers are emptied from reservoir 33 through tubing, in one or more batches, such as in two 400 ml batches, to a first concentration reservoir 81. They are exchanged through the filter 83, and a second concentration reservoir 82, by means of air pressure. The air is filtered in through a filter 811. The pressure valves 86 and 87, regulate the switching of the pressure from reservoir 81 to 82 and is controlled by weight with the weight controller 88, and platform scale 89. As air in reservoir 81 is pressurized, air in reservoir 82 is depressurized through a filter 810. The effluent is removed from the filter housing 83, through a filter 813, with a peristaltic pump 85. An additional pump 84, and filter 814, are available for filling the filter housing 83. After concentration, the concentrated bioengineered collagen fibers are transferred from reservoir 82 and loaded into a syringe 812.

An alternative preferred method for concentration of the composition is to either remove the composition from the system after filtration and rinsing or after partial concentration to about 10–20 mg/ml and then drying the composition, preferably by lyophilizing (i.e., freeze drying), to remove substantially all rinse agent to make a substantially dry composition. Once the composition is dry, the mass of the dry composition is easily determinable by weighing. After determining the weight, the composition may then be reconstituted by adding a specific amount of liquid carrier agent, preferably an aqueous carrier agent, to rehydrate the composition to form a reconstituted collagen fiber composition having a desired concentration. Composition concentrations beyond the limitations of the concentration apparatus of the invention may be achieved in this manner.

In another preferred embodiment, the delivery of bioengineered collagen fibers to a patient is performed by injection through a syringe where the composition is loaded after filtration or concentration into a syringe chamber and the composition is lyophilized or dried while in the syringe chamber. The dry composition may then be terminally sterilized and then stored sterile in the syringe for an extended amount of time until needed. When needed, the dry composition is then rehydrated by drawing a desired amount of aqueous carrier agent into the syringe to reconstitute the composition to form a reconstituted collagen fiber composition having a desired concentration. This concentration method is the preferred method due to the flexibility in the control over concentration levels by end-users, better dispensing repeatability at lower concentrations, and the extended product shelf life. For biomedical applications this embodiment would preferably be carried out as part of the aseptic system accomplished in the system described above by attaching a manifold onto an exit port from the concentration cylinders.

In dry form, terminal sterilization can be performed in the standard available methods including but not limited to gamma irradiation, electron beam irradiation and ultraviolet irradiation. It may be additionally desirable to crosslink the collagen fiber strands. Crosslinking provides strength to the collagen fibers and regulates bioremodeling of the collagen by patient's cells when implanted into a patient. Although crosslinking may be carried out without rinsing the collagen fiber strands after production, in preferred embodiments the collagen fiber strands are rinsed of coagulant prior to crosslinking. In FIG. 1, the crosslinking agent may be introduced to the production loop at input port 5.

Non-woven meshes and solid constructs can be made from this material by continued concentration from paste form to solid form. The result is a hydrated porous solid formed from bioengineered collagen fibers. This hydrated porous solid is accomplished by either mechanical compaction, injection molding using porous molds or other methods available to those skilled in the art. Different levels of compaction result in constructs with different mechanical properties.

In another preferred embodiment, the fiber strands are formed from collagen and remain hydrated after rinsing and concentration. Concentrated as an injectable formulation, the strands may range from 10–100 mg/ml, more preferably 20–60 mg/ml and most preferably 30–40 mg/ml. These levels of concentration can be achieved in the preferred embodiment of the production, filtration, and concentration methods and apparatus described above. For soft tissue constructs, more concentrated bioengineered collagen fibers are required. Mechanically forcing the fluid out of the bioengineered collagen fibers creates the desired construct. This is accomplished by compressing the bioengineered collagen fibers in a confined compression configuration using porous platens. Alternatively, filling a porous (solid or mesh) mold with bioengineered collagen fibers will accomplish this result. The force of injection into the mold forces the carrier fluid out through the pores that are too small to pass the bioengineered collagen fibers so that the fibers become compacted as more material in carrier fluid is forced into the mold. Another method is partially desiccating a dilute solution of strands by placing it in contact with porous materials. A less controlled method, although also suitable and desirable for irregular geometry, is mechanical handling and compression at atmospheric pressure (open air).

The bioengineered collagen fibers may be crosslinked with a crosslinking agent, preferably a chemical crosslinking agent that preserves the bioremodelability of the bioengineered collagen fiber material. Various types of crosslinking agents are known in the art and can be used such as ribose and other sugars, oxidative agents and dehydrothermal (DHT) methods. A preferred crosslinking agent is 1-ethyl-3-(3-dimethylaminopropyl) carbodiimide hydrochloride (EDC). In an another preferred method, sulfo-N-hydroxysuccinimide is added to the EDC crosslinking agent as described by Staros, J. V., Biochem. 21, 3950–3955, 1982. In the most preferred method, EDC is solubilized in water at a concentration preferably between about 0.1 mM to about 100 mM, more preferably between about 1.0 mM to about 10 mM, most preferably at about 1.0 mM. Besides water, phosphate buffered saline or (2-[N-morpholino]ethanesulfonic acid) (MES) buffer may be used to dissolve the EDC. Other agents may be added to the solution, such as acetone or an alcohol, up to 99% v/v in water, typically 50%, to make crosslinking more uniform and efficient. These agents remove water from the matrix fibers together to promote crosslinking. The ratio of these agents to water in the crosslinking agent can be used to regulate crosslinking. EDC crosslinking solution is prepared immediately before use as EDC will lose its activity over time. To contact the crosslinking agent to the bioengineered collagen fibers, the hydrated bioengineered collagen fibers are immersed in crosslinking agent for between about 30 minutes to about 24 hours, more preferably between 4 to about 16 hours at a temperature between about 4° C. to about 20° C. Crosslinking can be regulated with temperature: At lower temperatures, crosslinking is more effective as the reaction is slowed; at higher temperatures, crosslinking is less effective as the EDC is less stable.

Regardless of the starting material used in this process to form the strands, the removal of the rinse solution or fluid carrier from the strands allows the further entanglement and intertwining of the strands to provide a lattice structure that is continuously porous. The properties of the resulting material depend on the concentration of the strands and the strand dimensions. However, in all cases the strands go through a transition from a fluid to a viscoelastic fluid, to a viscoelastic solid as carrier is removed. The final material has the properties of a porous matrix demonstrable by creep compliance due to further fluid exudation and hydraulic permeability. The ability of this material to obtain different fundamental characteristics depending on the concentration of the strands is the core of the technology. A high degree of concentration to the extent that strand interactions (mechanical intertwining) are cohesive enough to provide a more solid like structure can be done in a number of ways. Some methods described below are based on the final purpose for the composition.

There are a few essential aspects of this class of material that make it particularly suited for injectable implantation, soft tissue constructs and cell scaffolding, or delivery devices. This material undergoes transitions to different levels of structure that are obtained depending on the degree of compaction or concentration of the material. Also, despite its solid-like behavior in the compacted state, the material is still a porous material with room for fluid to flow through and between the interconnecting strands providing a matrix that is accessible to host cell infiltration as well as nutrient support for those cells. These aspects of the material are borne by its unique response in creep testing and one-dimensional permeation tests. These assays apply to porous materials but not standard viscoelastic materials and the data demonstrates that the response of this material in those assays is dependent on the concentration of the material.

As an injectable composition, bioengineered collagen fibers provide a unique advantage due to its concentration dependent structure. The material can be injected as a fluid into the host tissue and the forces of the displaced tissue act on the bioengineered collagen fibers forcing the fluid carrier to exude from the implant thus, in effect, concentrating the bioengineered collagen fibers into a matrix in situ. There is a structural transition that the bioengineered collagen fibers undergo as it changes from a fluid to a solid. The degree of in vivo compaction and solidification of the bioengineered collagen fibers is a function of the hydraulic permeability and of the lattice structure (compressive resistance) of the bioengineered collagen fibers as described above and the properties of the surrounding tissue.

As an injectable paste or compacted solid composition, these bioengineered collagen fibers are useful for implantation into a patient for repair or replacement of tissue, tissue augmentation, cell delivery, or delivery of cytokines, growth factors or genetically modified DNA. The injectable collagen fiber composition of the invention is useful for tissue augmentation, particularly for bulking up the urinary sphincter in incontinent patients.

The following examples are provided to better explain the practice of the present invention and should not be interpreted in any way to limit the scope of the present invention. It will be appreciated that the device design in its composition, shape, and thickness is to be selected depending on the ultimate indication for the construct. Those skilled in the art will recognize that various modifications can be made to the methods described herein while not departing from the spirit and scope of the present invention.

EXAMPLES

Example 1

Bioengineered Collagen Fibers (ECF) Made From Collagen Solutions

This study was carried out to demonstrate the flexibility of the production method in that it is capable of producing the collagenous strand formulations from numerous different types of collagen solutions. The one step extrusion production method described in the preferred embodiment of the manufacturing apparatus described above with 20% PEG (MW 8000) at 700 mOsm as the coagulation agent was used. In this example the purpose was only to make small batches of the material. In this Example, the apparatus of FIG. 1 employing the bag filter 24, was used to collect and remove the formed collagen strands.

We have successfully produced collagen strands from the following collagen preparations:

Telopeptide intact, acid extracted, bovine tendon collagen Type I in 0.05% acetic acid solution at pH 3.5 at the following concentrations: 1 mg/ml, 2 mg/ml, 3 mg/ml, 4 mg/ml, 4.6 mg/ml, 5 mg/ml and 5.5 mg/ml.

Atelopeptide collagen, pepsin digested collagen Type I from bovine hides (Vitrogen 100®; Collagen Corporation, Palo Alto, Calif.) in Hydrochloric Acid at pH 2.0.

Collagen stand compositions were formed using the apparatus and collected in the bag 24. Samples of strands were selected from each collagen preparation, measured and examined under light microscopy. A range of strand dimensions from 1 mm to 15 mm in length and 0.2 mm to 0.7 mm in width was achieved with each of the above noted collagen solutions.

Example 2

Bioengineered Collagen Fibers (ECF) Made Using Various Coagulation Agents

This example demonstrates the flexibility of the production method in that it is capable of producing the collagenous strand formulations using different coagulation buffers. The one step extrusion production method described in the preferred embodiment of the manufacturing apparatus described above using acid extracted collagen in 0.05% acetic acid at pH 3.5. Because the purpose of this study was to make only small batches of the material, the bag filter 24 (shown in FIG. 1), was used to collect and remove formed collagen strands from the system and used to contain the sample as it was concentrated by compressing excess fluid from the sample. Samples of strands were selected from each collagen preparation, measured and examined under light microscopy.

From this study, collagen strands were produced using the following PEG based coagulation buffers which vary in the molecular weight, the amount of PEG used, and the osmolality of the buffer and its ionic content. The buffer conditions are listed below in Table 1. The strand dimensions formed ranged from 1 mm to 15 mm in length and 0.2 mm to 0.7 mm in width.

TABLE 1

| Buffer # | % PEG | Mol. Wt. | mOsm | Buffer Formulation |
|---|---|---|---|---|
| 1 | 20 | 8000 | 700 | 2000 g PEG 8000, 142.00 g $Na_2HPO_4$, 20.00 g $NaH_2PO_4$, fill to 10 liter volume with RODI water |
| 2 | 9.2 | 200 | 700 | 1000 g PEG 1000, 28.40 g $Na_2HPO_4$, 4.00 g $NaH_2PO_4$, fill to 9.25 liter volume with RODI water |
| 3 | 0 | not applicable | 700 | 85.20 g $Na_2HPO_4$, 12.00 g $NaH_2PO_4$, fill to 2 liter volume with RODI water |

TABLE 1-continued

| Buffer # | % PEG | Mol. Wt. | mOsm | Buffer Formulation |
|---|---|---|---|---|
| 4 | 0 | not applicable | 1200 | 160.80 g $Na_2HPO_4$, 22.60 g $NaH_2PO_4$, fill to 2 liter volume with RODI water |
| 5 | 20 | 1000 | 700 | 200 g PEG 1000, 5.08 g $Na_2HPO_4$, 0.72 g $NaH_2PO_4$, fill to 1 liter volume with RODI water |
| 6 | 10 | 8000 | 700 | 600 g PEG 8000, 159.94 g $Na_2HPO_4$, 22.60 g $NaH_2PO_4$, fill to 6 liter volume with RODI water |
| 7 | 20 | 8000 | 443 | 1200 g PEG 8000, 33.81 g $Na_2HPO_4$, 4.82 g $NaH_2PO_4$, fill to 6 liter volume with RODI water |
| 8 | 20 | 8000 | 355 | 1200 g PEG 8000, 25.00 g $Na_2HPO_4$, 3.50 g $NaH_2PO_4$, fill to 6 liter volume with RODI water |

Example 3

Bioengineered Collagen Fibers (ECF) Made in Varying Dimensions

The collagen strands produced by the one step extrusion production method described above are repeatably produced both within a batch and in comparisons between batches.

A syringe pump was used to extrude acid extracted collagen at 5.6 mg/ml at a rate of 0.8 ml/min through a 20-gauge needle into a closed PEG stream. The coagulation buffer was polyethylene glycol (PEG) 8000 MW at 20% w/v and 700 mOsm. The PEG flow rate was set at 500 ml/min in ¼" diameter tubing at the point of collagen extrusion at midstream. Thirteen batches made in this way had strands with lengths and widths of 7.7 mm and 0.64 mm respectively on average. The standard deviations for length and width were 0.35 mm and 0.03 mm respectively.

Long thin strands can be produced by using a 25 gauge needle instead of a 20 gauge needle and modifying the collagen and PEG flow rates. The following Table 2 demonstrates a number of different formulations with the appropriate flow rates. The within batch variability is noted for each batch as standard deviation (SD) for both length (L) and width (W) in the table:

TABLE 2

| PEG flow (ml/min) | Collagen Flow (ml/min) | Needle | Length | SD (L) | Width | SD (W) |
|---|---|---|---|---|---|---|
| 900 | 0.05 | 25 | 1.77 | 0.27 | 0.341 | 0.08 |
| 1200 | 0.05 | 25 | 2.04 | 0.42 | 0.26 | 0.08 |
| 495 | 0.01 | 25 | 2.56 | 0.66 | 0.27 | 0.05 |
| 705 | 0.1 | 25 | 3.53 | 0.36 | 0.28 | 0.11 |
| 1200 | 0.1 | 25 | 2.51 | 0.46 | 0.23 | 0.08 |
| 1005 | 0.1 | 25 | 1.3 | 0.35 | 0.36 | 0.05 |
| 240 | 0.2 | 25 | 17.81 | 1.92 | 0.51 | 0.14 |
| 300 | 0.2 | 25 | 20.03 | 3.01 | 0.53 | 0.12 |
| 395 | 0.2 | 25 | 9.52 | 1.79 | 0.39 | 0.07 |
| 510 | 0.2 | 25 | 7.59 | 1.17 | 0.39 | 0.09 |
| 810 | 0.2 | 25 | 3.88 | 0.51 | 0.32 | 0.08 |
| 900 | 0.2 | 25 | 2.91 | 0.59 | 0.24 | 0.09 |
| 1155 | 0.2 | 25 | 1.35 | 0.38 | 0.34 | 0.08 |
| 1305 | 0.2 | 25 | 1.51 | 0.44 | 0.33 | 0.06 |
| 1005 | 0.2 | 25 | 3.03 | 0.82 | 0.28 | 0.1 |

TABLE 2-continued

| PEG flow (ml/min) | Collagen Flow (ml/min) | Needle | Length | SD (L) | Width | SD (W) |
|---|---|---|---|---|---|---|
| 1005 | 0.4 | 25 | 3.82 | 0.64 | 0.34 | 0.08 |
| 1500 | 0.4 | 25 | 2.86 | 1.23 | 0.25 | 0.09 |

Example 4

Bioengineered Collagen Fibers (ECF) Prepared as an Injectable Composition

The needle size and concentration of the collagen strand composition both effect the force required for extrusion, such as when the composition is administered to a patient. The ability to inject the material using a syringe was evaluated in two ways: (1) A syringe with a needle attached is mounted on an MTS Bionix testing system and a volume of material was extruded at a constant flow rate and the force recorded; and, (2) The material was extruded from a syringe by hand and the force is recorded from an attached load cell.

The following are specific examples of prepared injectable formulations of the strands. A material is considered to be injectable if it requires less than 40 N of force to extrude the material from a syringe (Wallace, 1989). The collagen strand formulations described herein were extruded with 15–25 N of force through 20 gauge needles:

Composition 4A: The length and width of the collagen strands were 11.1 (SD±1.4) mm and 0.57 (SD±0.13) mm respectively and the concentration of collagen in the composition containing strands and carrier was 49 mg collagen/ml. Extrusion through a 20 gauge needle from a 3 ml syringe required 19.2 N (48.1 max) by hand and 21.7 (SD±9.7) N at 5 ml/min on the MTS.

Composition 4B: The length and width were 4.17 (SD±1.28) mm and 0.58 (SD±0.12) mm respectively and the concentration of collagen in the composition containing strands and carrier was 61 mg collagen/ml. Extrusion through a 20 gauge needle from a 3 ml syringe required 18.8 N (53.0 N max) by hand and 22.4 (SD±14.6) N at 5 ml/min on the MTS.

Composition 4C (Effect of concentration and needle gauge): Higher concentration and needle gauge (smaller diameter bore) increase the force required for extrusion. This formulation was tested at 50, 70 and 85 mg collagen/ml on the MTS using 18, 20 and 22 gauge needles. The Table 3 below indicates the force in Newtons required for extrusion.

TABLE 3

| | Collagen Concentration (mg/ml) | | |
|---|---|---|---|
| Needle Gauge | 50 mg/ml | 70 mg/ml | 85 mg/ml |
| 18 | 6.8 (1.2) | 18.5 (3) | 40.8 (1.6) |
| 20 | 10.1 (1.7) | 32.4 (4.4) | 59.9 (3.5) |
| 22 | 20.4 (4.4) | 55.3 (5.4) | 118.8 (5.8) |

Example 5

Bioengineered Collagen Fibers (ECF) Prepared as a Lattice for Cell Growth in Culture ECF was made as described in the preferred embodiment and concentrated only to approximately 5 mg/ml. Mid-sized strands were made for the following constructs.

Sample 5A: The ECF is poured in dilute homogeneous form into a transwell. Then the carrier was drawn out of the ECF from the bottom by capillary action using an absorbent material. In this way the ECF forms a cohesive layer at the base of the transwell. Cells are then added to the surface of the layer and infiltrate the layer easily. The cells adhere to the matrix, are viable and function normally.

Sample 5B: ECF made from NaOH treated collagen was used for this sample. The material was lyophilized, gamma sterilized and then reconstituted with 10% (v/v) phosphate buffered saline to a concentration of 12.47 mg/ml, determined via hydroxyproline assay. Sterile 60 mm petri dishes were filled, wrapped in sterile 'blue-wrap', and frozen at −80° C. for 2 hours. They were then lyophilized for approximately 2 days. The ECF formed a coherent matrix in the petri dish. Subpassaged human dermal fibroblasts were seeded to the matrix in culture medium comprising DMEM containing newborn calf serum. The cell growth on the construct was healthy with evidence of cell ingrowth into the construct.

Example 6

Permeability of Bioengineered Collagen Fibers (ECF)

Figure 3:
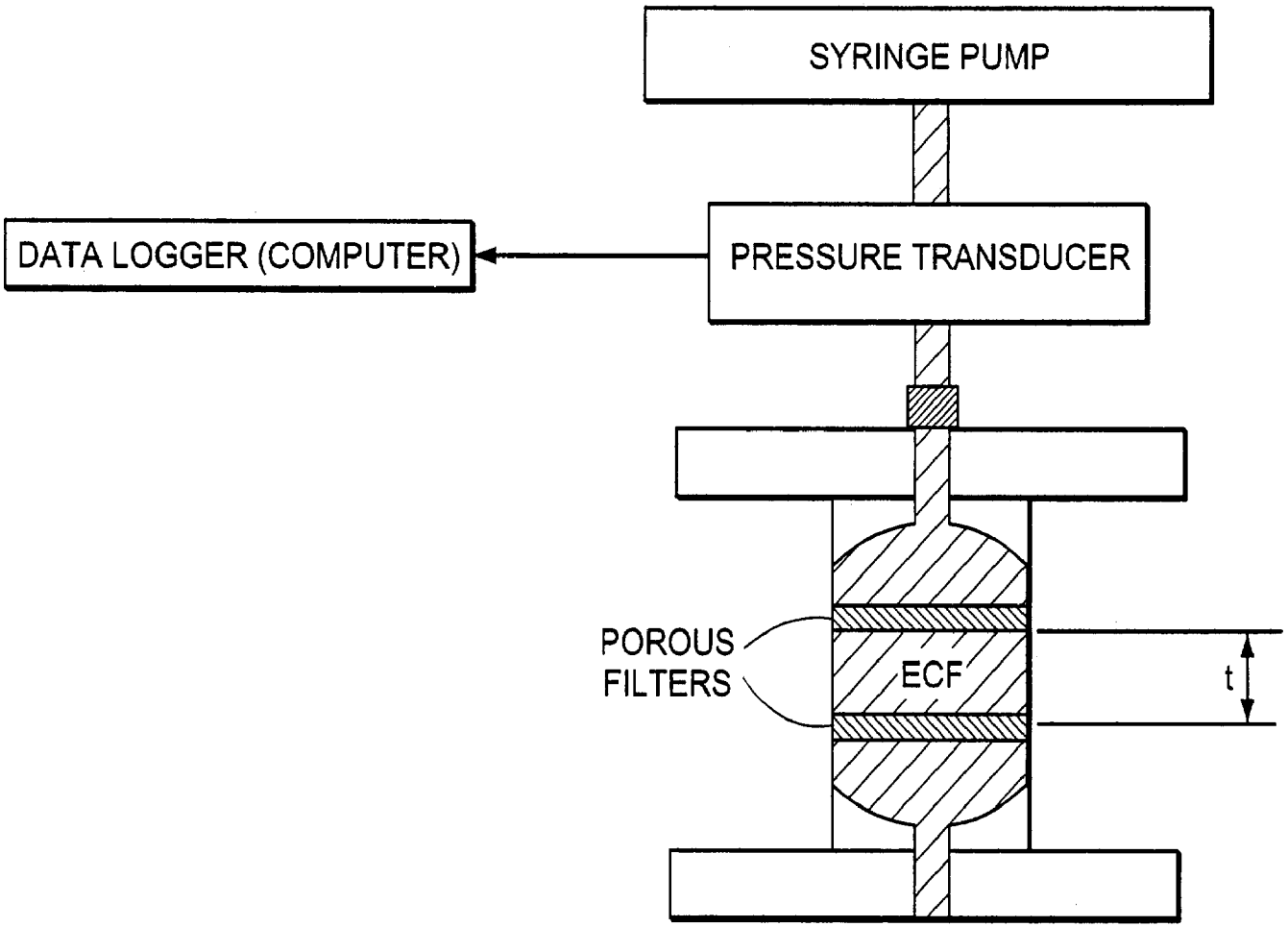
FIG. 3 is a schematic representation of the one dimensional permeation testing apparatus used to determine the permeability of bioengineered collagen fiber formulations.

One-dimensional permeation experiments were conducted on ECF made from both long wide strands (LW) and short thin strands (ST). An axially symmetric apparatus was designed to hold ECF between two porous filter discs at a prescribed and adjustable thickness (t) (FIG. 3). Water is forced through the ECF using a syringe pump and the pressure is recorded on an in-line pressure transducer coupled to a data logger. After ½ ml of ECF is loaded into the chamber providing an initial thickness (t), t=4 mm, the pressure is increased to 5 psi using a flow rate (Q) of 1 ml/min. The flow is then reduced to 0.1 ml/min and the pressure level (P) is monitored until a plateau is reached. This pressure is used to calculate the apparent permeability as: $k_{app}=(Q\cdot t)/(P\cdot A)$, where A is cross-sectional area of the filters. The thickness of the ECF was then reduced in this experiment in increments of 0.8 mm, by mechanically compressing the sample between the porous filters. Dilatation of ECF in this way is equivalent to concentration of the ECF paste. The permeability at each point was used to determine the strain dependant permeability (or concentration dependence of permeability) by fitting the data to the exponential law established by Lai et al (1980) for soft tissues, $k_{app}=k_o\exp(-M\cdot e)$, where e is the dilatation of the matrix.

Figure 4:
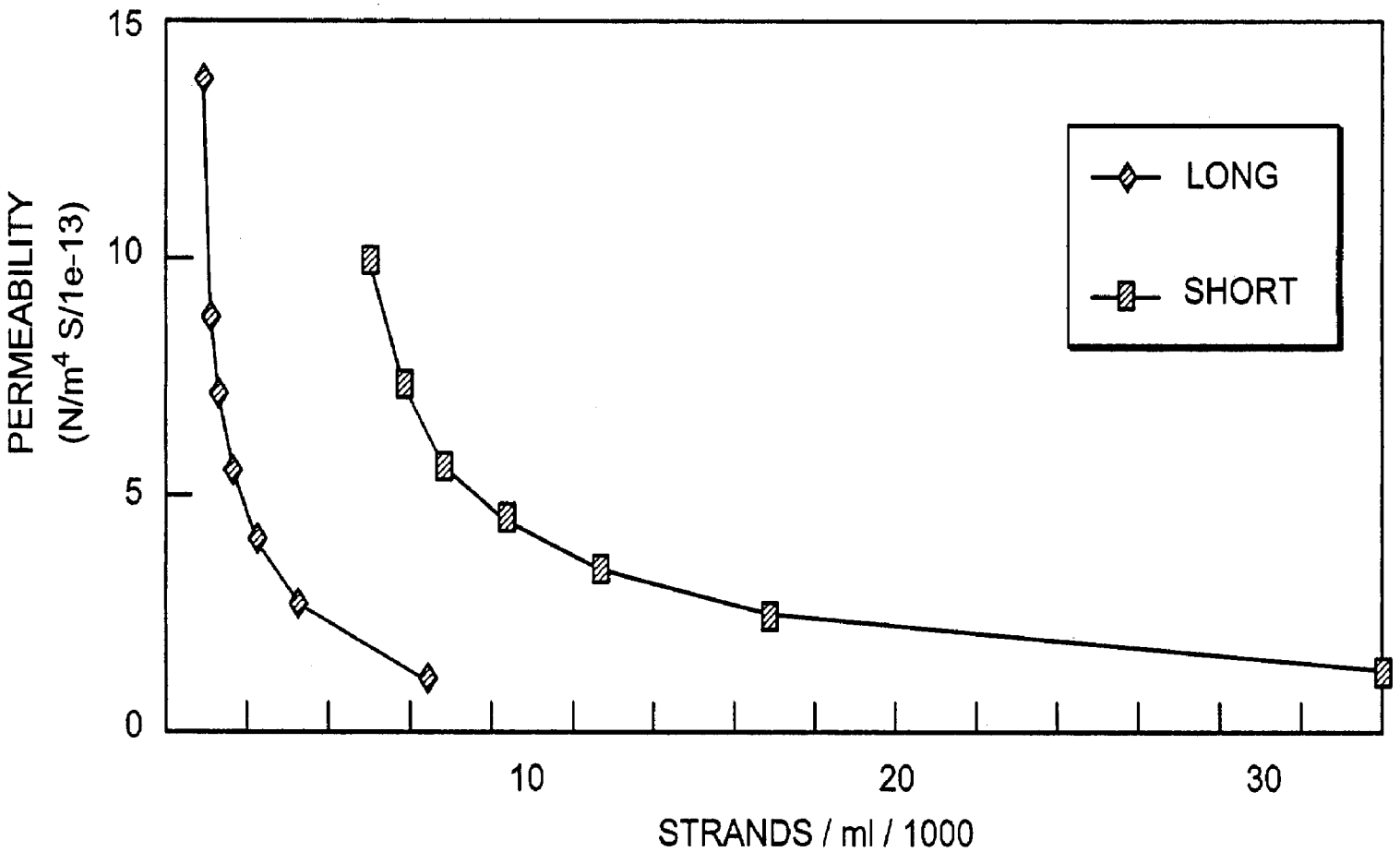
FIG. 4 depicts the permeability values for different formulations at different concentrations.

The results show that at a specific concentration there is a substantial decrease in permeability due to a structural change in the ECF material as the individual strands intertwine and provide a cohesive matrix. At this transition the strand concentrations were 13,000 and 80,000 strands/ml for the LW and ST formulations respectively. The permeability values at that point were comparable at 13.8e−13 $m^4/Ns$ (LW) and 12.8e−13 $m^4/Ns$ (ST). Compaction of the ECF decreased the permeability in a non-linear fashion as seen in FIG. 4. The transition concentration (and thickness) for each formulation was used as the starting point to calculate dilatation in the strain dependent permeability analysis. Both formulations fit well to the model with $R^2=0.991$ in both cases. The fit parameters were $k_0=13.4$ $m^4/Ns$ and M=2.3 for the LW material and $k_0=13.0$ $m^4/Ns$ and M=1.9 for the ST material.

The permeation results demonstrate the continuity of the porous structure and the suitability in that regard as a soft tissue implant. It also demonstrates that the structure of ECF changes with the dimensions of its component strands and their concentration. It follows that ECF could be modified to provide implants of different structures to suit the needs of a particular application. It is clear from a mechanical standpoint that the permeability of the structure is a function of the ECF dimensions and concentration.

Example 7

Creep Compression Evaluation of Bioengineered Collagen Fibers (ECF)

Figure 5:
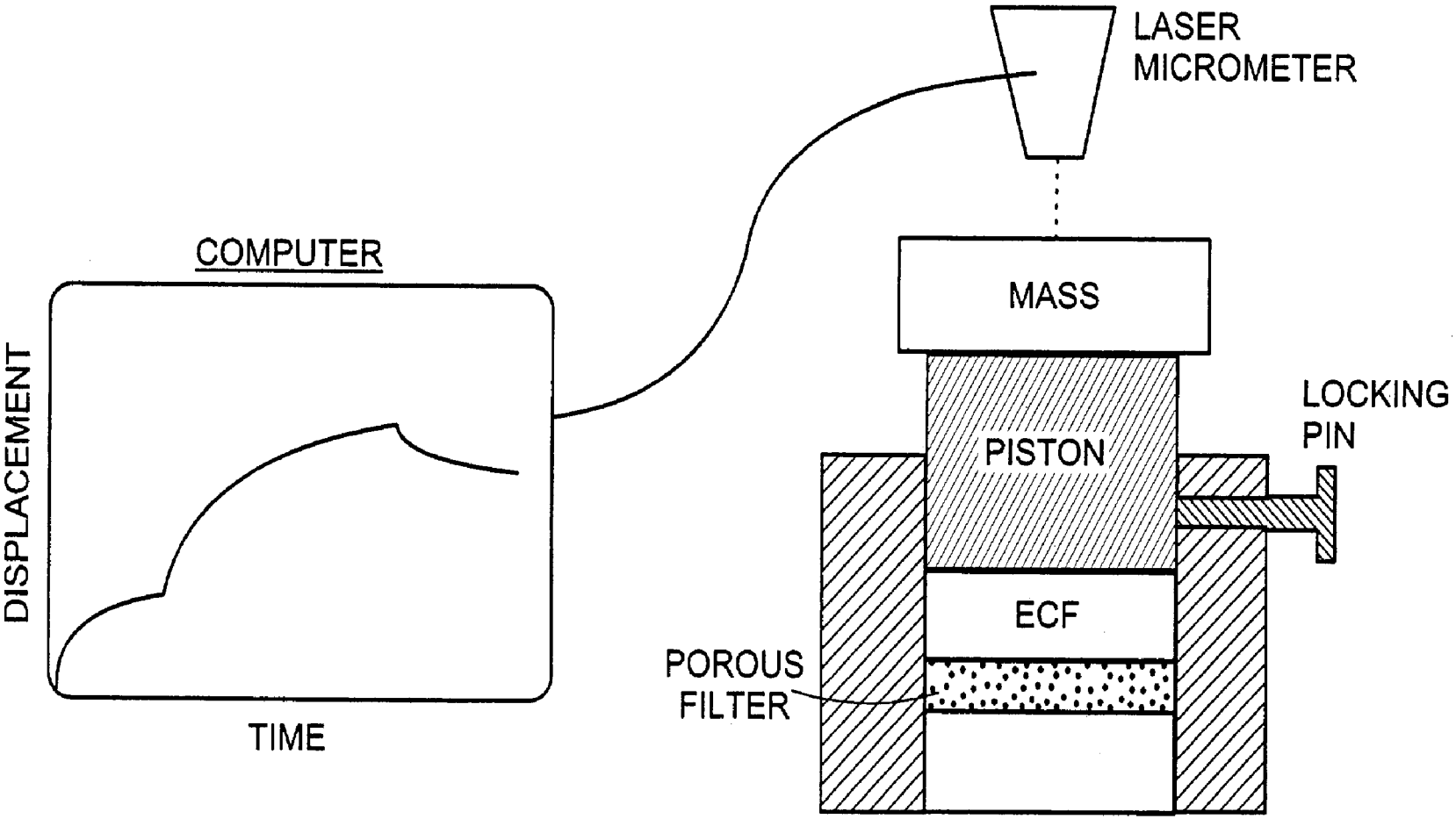
FIG. 5 is a schematic representation of the axisymmetric confined compression loading device used to determine the creep response of bioengineered collagen fiber formulations in compression.

Samples of ECF (0.8 ml) were subjected to uniaxial confined compression between a solid piston and a porous filter. The apparatus that was used is schematically shown in FIG. 5. A locking pin was used to initiate step loading and fix displacement for material equilibration as needed. A laser micrometer recorded both reference heights and displacements of the piston over time. The loading protocol was as follows: a tare load of 0.77 kPa was applied and allowed to equilibrate for 10 minutes. This was considered as the reference loading state. Subsequently, a step load of 3.9 kPa was applied and the specimen creep was monitored for one hour. The piston was then locked for ten minutes to allow for any further equilibration of the sample. This was followed by-a-step load of 15.6 kPa applied to the same sample for three hours. Again the piston was locked in place and the sample was allowed to equilibrate. Next the load was removed and the recovery of the sample was monitored for one hour still under the tare load. For each of the three phases strains were calculated as displacement relative to the height of the sample at the start of the phase. Empirical models were evaluated to determine the best description of the creep and recovery data as a means for comparing the LW and ST formulations and the creep versus recovery response for a given formulation.

Figure 6A:
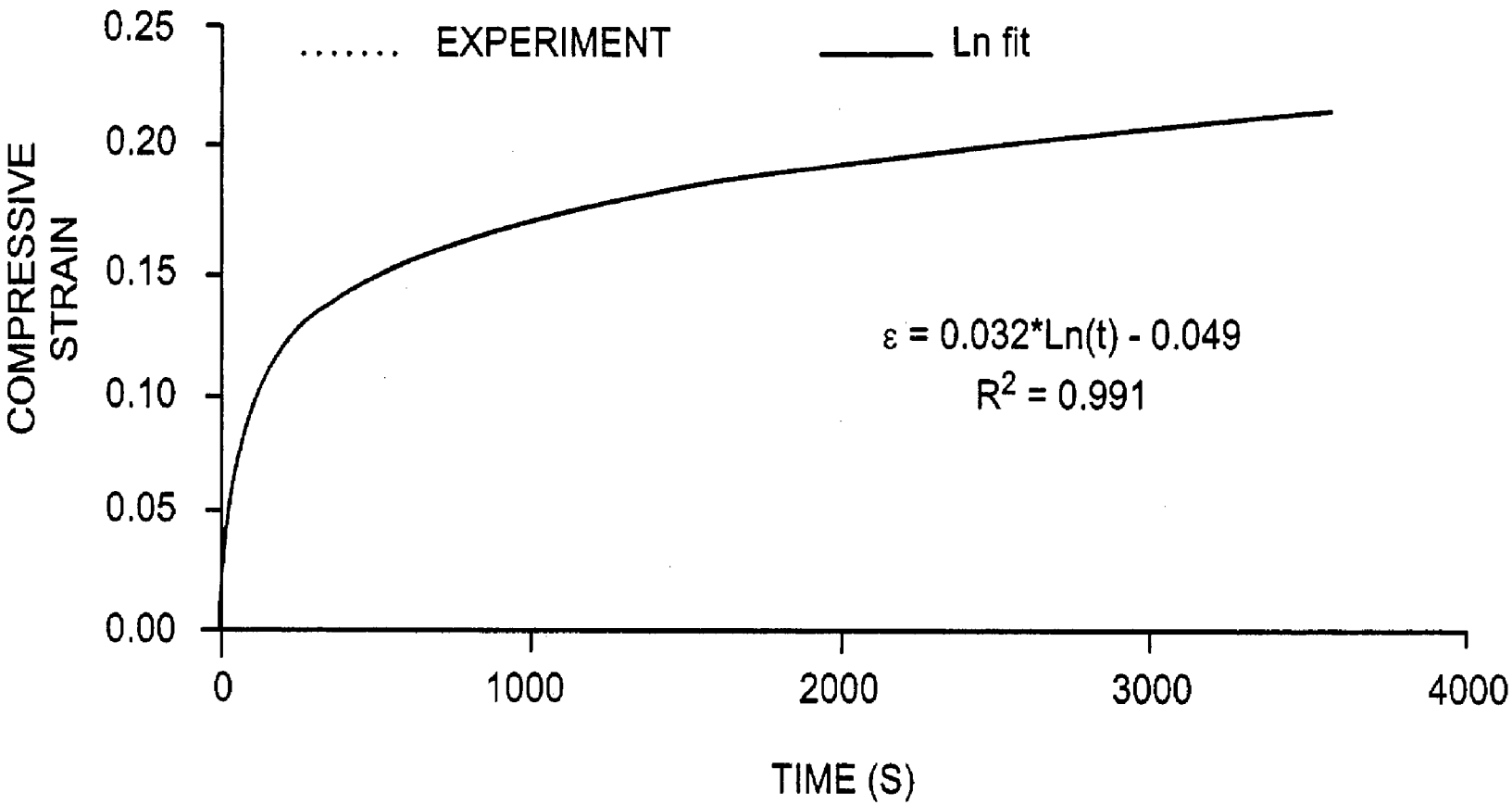
FIG. 6*a* shows low load creep response; 6*b*, high load creep response of compacted bioengineered collagen fibers, and 6*c*, the recovery response of bioengineered collagen fibers after compression.
Figure 6B:
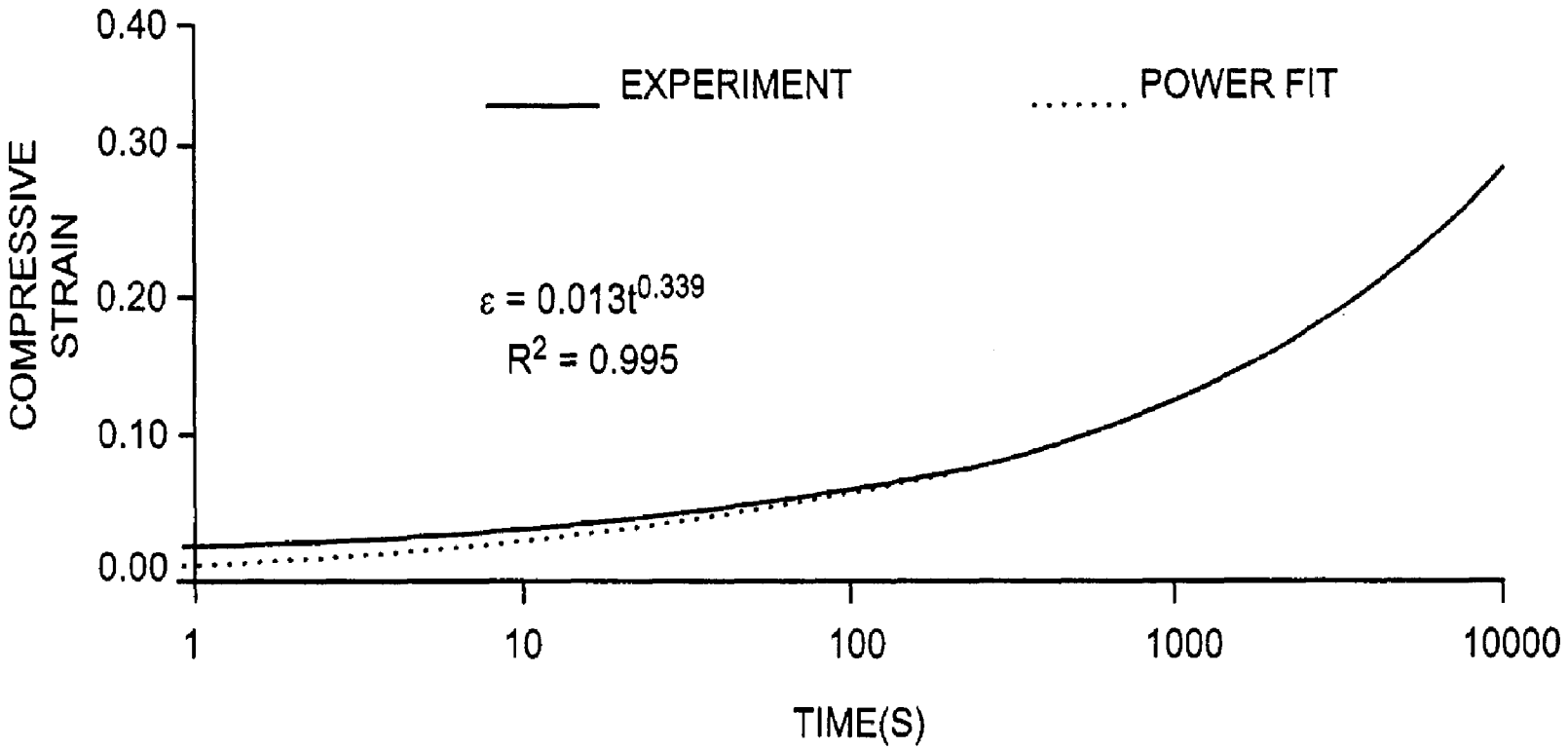
FIG. 6 shows representative graphs of the load response on bioengineered collagen fiber compositions.
Figure 6C:
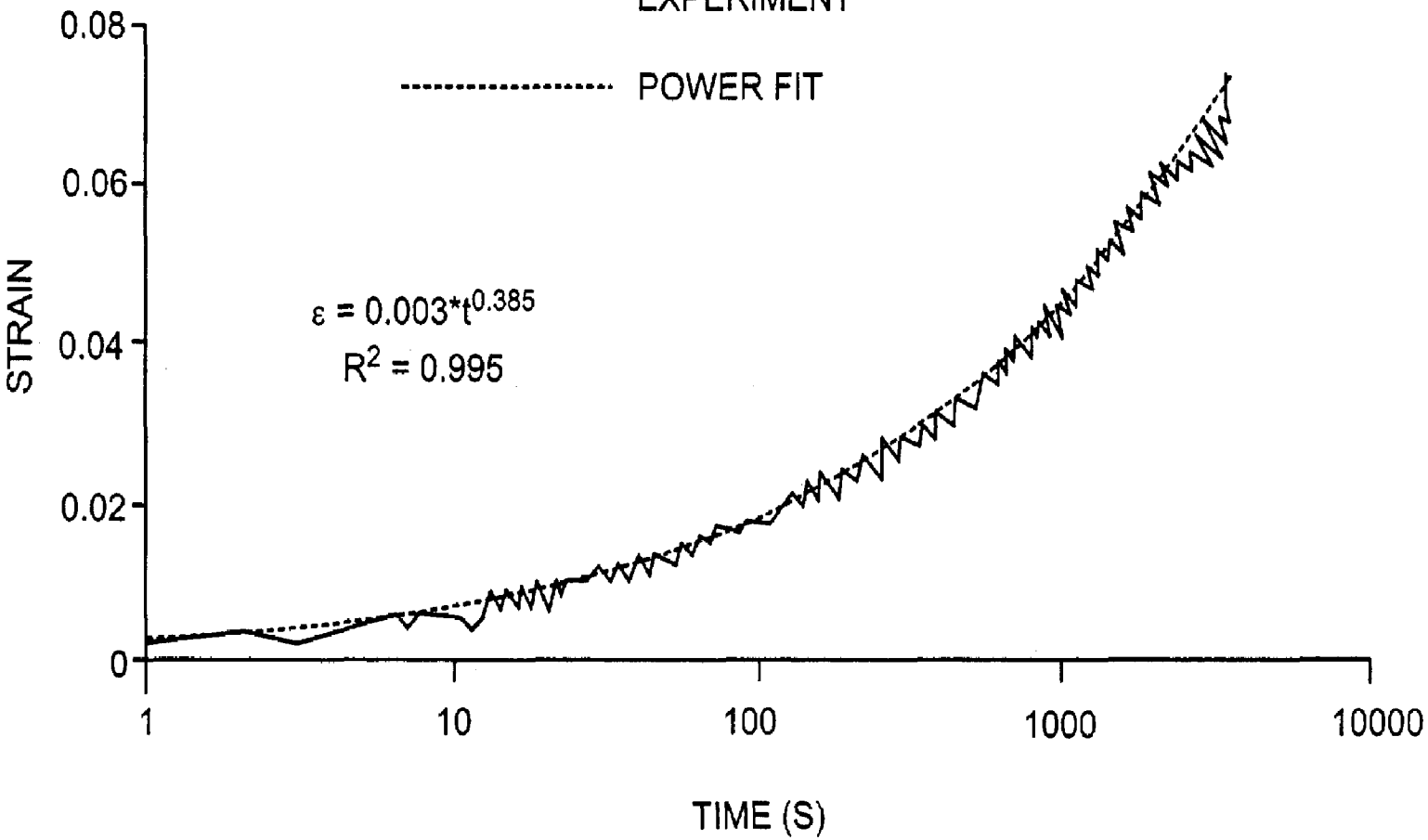

A log-linear model, $\epsilon=M*\ln(t)-c$, was successfully fit to the experimental data for the first stage of creep even for the very early time points (FIG. 6*a*). For both the second loading phase and the recovery phase of the test a power law model, $\epsilon=bt^{\alpha}$, fit the data very well (FIGS. 6*b* and 6*c*). The results from these empirical fits are shown in the Table 4 below.

TABLE 4

| N = 5 | M* | α | Recovery* α | b | Recovery b* |
|---|---|---|---|---|---|
| Longer Wider (8 mm) | 0.033 ± 0.002 | 0.338 ± 0.088 | 0.355 ± 0.050 | 0.023 ± 0.022 | 0.004 ± 0.002 |
| Shorter Thinner (2 mm) | 0.040 ± 004 | 0.358 ± 0.042 | 0.231 ± 0.072** | 0.012 ± 0.004 | 0.014 ± 0.007 |

*Significant difference between formulations using student's t-test ($p < 0.05$).
**Significant difference between compression and recovery using student's test ($p < 0.05$).

By using these models the LW and ST formulations of ECF can be distinguished in their creep and recovery responses. The initial compression rate is faster (larger M, $p<0.05$) and Recovery rate is slower (smaller α (alpha) $p<0.05$) for shorter thinner strands compared with longer wider strands. Also, the recovery rate is slower (smaller α (alpha) $p<0.05$) than the compression rate for the ST material.

This assay demonstrates the continuously porous structure of the ECF matrix. Concentration and the dimensions of its component strands influence that matrix's compressive response kinetics.

Example 8

Mechanical Compaction of Bioengineered Collagen Fibers (ECF)

Bioengineered collagen fibers were loaded (0.8 ml) into a confined compression system (FIG. 5) for an initial height of about ¼". A polycarbonate piston was lowered onto the material and then weights were added to the top of the piston. Adding 200 g to the piston (15.9 kPa) resulted in a compressed, compacted construct of bioengineered collagen fibers with a height less than ¼" within 24 hours. The construct was removed from the interior of the compression system for testing and evaluation. The compacted bioengineered collagen fiber construct maintained its shape and was mechanically stable even when agitated in water for several days.

Example 9

Short Term Compaction and Long Term Persistence of Bioengineered Collagen Fibers (ECF) in a Rabbit Subcutaneous Ear Model The collagen matrix made as described above was injected subcutaneously into the ears of New Zealand white rabbits using a 20 g needle. Prior to injection the height of the implant site was measured using a micrometer caliper. Immediately after injection the height of the implants were measured. All implants were 0.5 ml. Persistence was defined as the height of the implant at the time of measurement ($h_t$) relative to the initial height of the implant ($h_0$). In one experiment short term compaction was investigated while a second experiment focused on the long term persistence of implants made from different size strands. In the short term experiment the height of the implant was measured at 1 hour ($h_0$), 4 hours, 3days. In the long term experiment the implants were measured at 1 ($h_0$), 21, 42, 84, 180, and 330 days. The animals were sacrificed at those times (except day 1) and the implants were cut from the surrounding tissue, fixed in formalin, and stained with hemotoxylin and eosin for histological evaluation.

Figure 7:
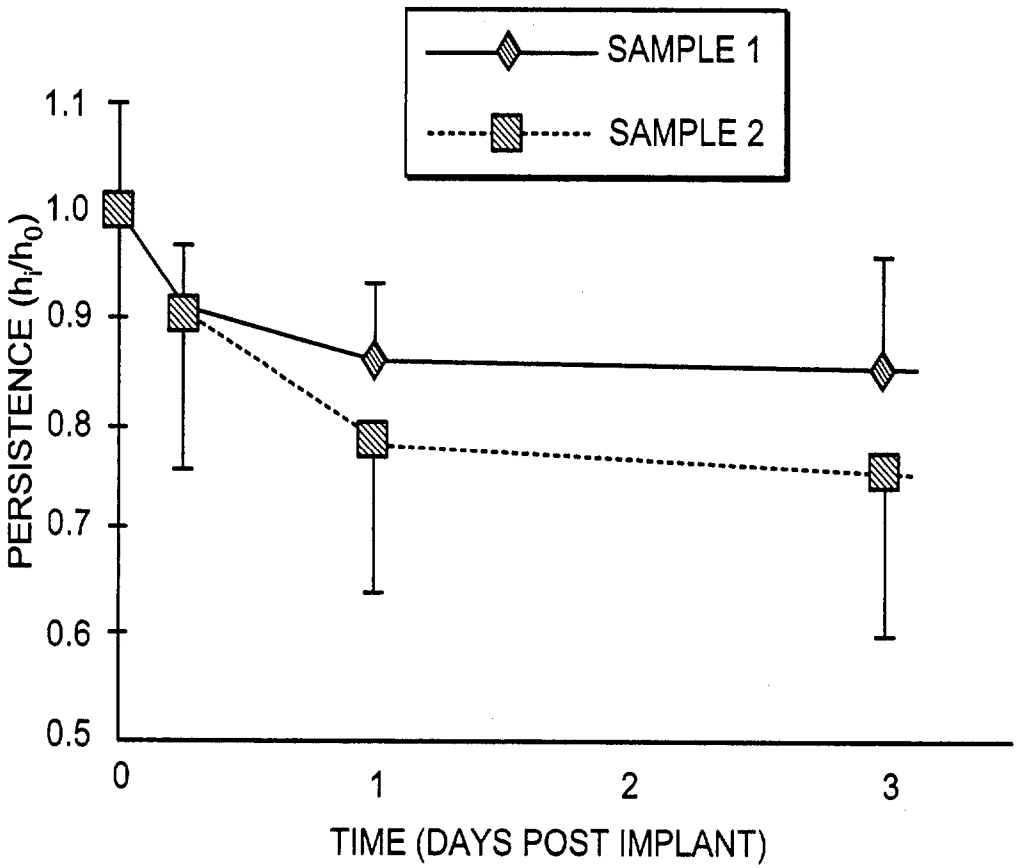
FIG. 7 shows the short term compaction of two formulations of bioengineered collagen fibers in the subcutaneous implant in the rabbit ear.
Figure 8:
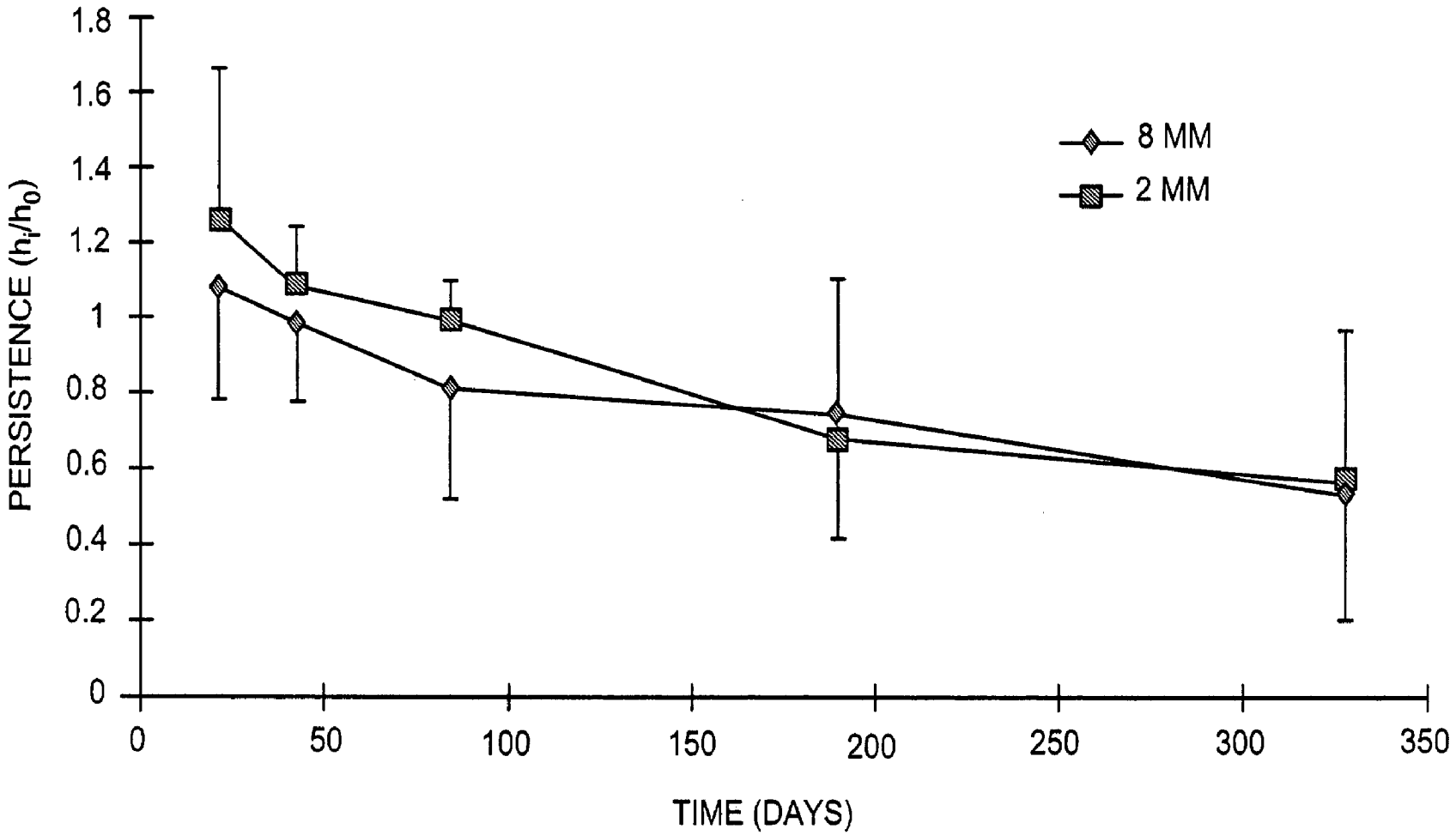
FIG. 8 demonstrates the persistence of the subcutaneous implant height in the rabbit ear over 330 days for both long and wide strand bioengineered collagen fibers and short and thin strand bioengineered collagen fibers.

During the first 3 days the height of the implant is reduced by 15–25% (FIG. 7). This is due to the initial compaction or concentration of the strands from an injectable paste to a viscoelastic solid, by the surrounding tissue forces. The permeability and elasticity of the formulation, the surrounding tissue in situ, and the volume and concentration of the implanted material determine the degree of fluid exudation from the implant. Persistence of the implant height over 330 days for both LW and ST materials is shown in FIG. 8. The implant is palpable and measurable over the entire period and still retains 50% of its height at 330 days. Histological evaluation indicates vascularization of the implants and fibroblast ingrowth as well as substantial new collagen deposition by 3 months. At 330 days there is still a substantial amount of the initial implant at the site of implantation. There is no evidence that the ECF strands are dispersed to surrounding areas.

Example 10

Long Term Persistence of Bioengineered Collagen Fibers (ECF) in a Rabbit Intramuscular Model The collagen matrix made as described above in the preferred embodiment was injected into the hind leg muscle of New Zealand 15 white rabbits using a 20 g needle. All implants were 0.5 ml. Persistence and migration of the -material was assessed from histological sections. The implants were sacrificed at 21, 42, 84, 180, and 330 days, three at each time point, and the implants were cut from the surrounding tissue, fixed in formalin, and stained with hemotoxylin and eosin for histological evaluation. The implants were found to integrate well over time with adjacent muscle tissue. There was some host cell infiltration without a lot of remodeling. The implants were well contained within the muscle with very little spreading. Also, rabbit sera were tested and found to be negative for collagen specific antibodies.

Example 11

Figure 9:
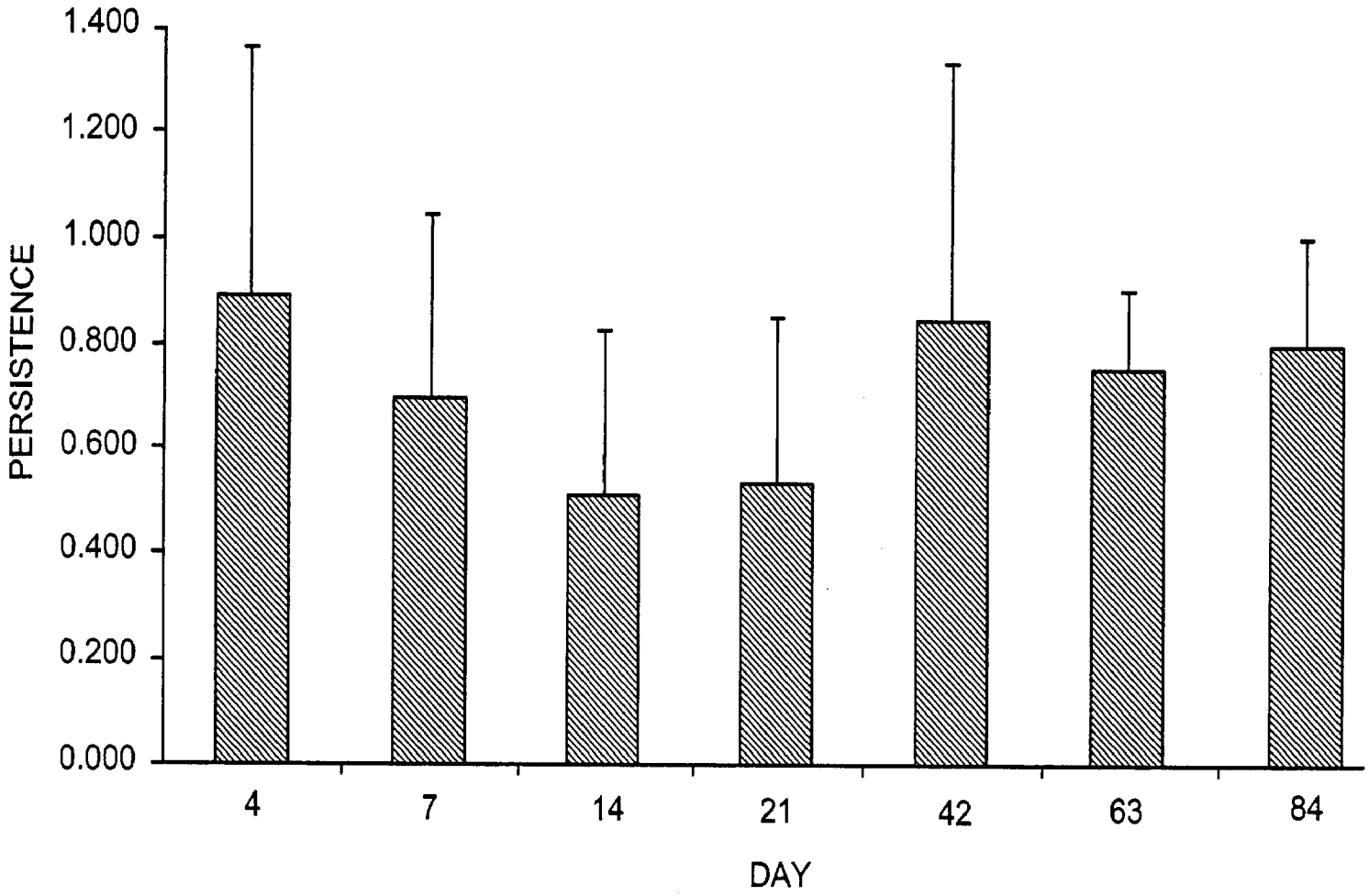
FIG. 9 demonstrates the persistence of the subcutaneous implant height in the rabbit ear over 84 days for bioengineered collagen fibers made using Vitrogen 100 collagen.

Bioengineered Collagen Fibers (ECF) Made From Atelopeptide Collagen in a Rabbit Ear Persistence Model An injectable collagen composition made according to the method described above was produced using Vitrogen 100 as the starting collagen solution. Eight rabbits were injected in both ears with the material and persistence was measured at 4, 7, 14, 21, 42, 63 and 84 days. Half of the animals were sacrificed at 21 days and the rest at 84 days, for histological evaluation. The persistence relative to day 1 was maintained at almost 80% for some implants for 84 days. Data is shown in FIG. 9. Histological evaluation indicated a very dormant host response to the material. Also the material remained localized at the implantation site. Rabbit sera were tested and found to be negative for collagen specific antibodies.

Example 12

Additional Formulations of Bioengineered Collagen Fibers (ECF) in the Rabbit Models The models described in the previous examples were used to evaluate the following formulations of the material as well: (1) material that had not been terminally sterilized with peracetic acid (but produced under aseptic conditions); (2) material that had undergone lyophilization prior to implantation; (3) material that had undergone lyophilization and terminal sterilization by gamma irradiation; and, (4) a formulation produced using PEG with a low osmolality (430 mOsm). All formulations were successfully injected into the rabbit ear model and compacted to varying degrees. The compositions stayed in the targeted location in both the muscle and the ear models and were measurable at three months.

Example 13

Bioengineered Collagen Fibers (ECF) Used in a Minipig Model for Wound Filling

Collagen fiber compositions were made in an equivalent system to that described above. In this example the coagulation buffer used for production was a low osmolality (430 mOsm), 20% w/v polyethylene glycol (PEG) buffer. In this example the material was lyophilized after concentration, gamma irradiated for terminal sterilization and reconstituted with phosphate buffered saline before use.

Three minipigs were used in this example, one for each time point: 5, 10 and 21 days. Each animal received 14 wounds on its back (2 rows of seven parallel to the spine) made by biopsy punch 1 cm in diameter. Ten wounds were filled with the collagen fiber composition and 4 were left untreated. All were dressed only with an occlusive spray on dressing (Op-Site).

The endpoints criteria included vascularization, epithelial advance, epithelial projections (rete pegs), and matrix density. Vascularization was assessed by manual counting of blood vessels within the wound under a light microscope. This data was collected only for day 21. Epithelial advance was determined as a percent of total wound width on histological sections. These measurements were made manually and for all time points. The number of rete pegs per unit length was counted as a measure of the quality of wound closure at 21 days. Matrix density both within and adjacent to the wound was quantitatively measured using image analysis techniques. These assessments were made using Picro Sirius Red (PSR) staining, which shows only matrix, and polarized light microscopy. The cellular response was evaluated using hemotoxilin and eosin stained sections.

The results indicated showed the treated wounds to be rich in fibrin after 5 days and there was an extensive fibroblast proliferation accompanied by collagen deposition. There was notably no ECF remaining in the wounds indicating its apparent dissolution/degradation. After five days there was not statistical difference in epithelial advance between the ECF treated and the untreated wounds. Both were about 22–23% covered. However, after 10 days the ECF treated wounds were 85% covered while the untreated wounds were 72% covered and this difference was statistically significant ($p<0.001$).

At 10 days in normal pig wounds there was a fair amount of epithelialization and the granulation tissue was rich in proliferating fibroblasts. There was conspicuously denser collagen deposition in the granulation tissue of ECF treated wounds compared with the untreated wounds. In some sections the tissue was similar to that seen in control sections at 21 days. There was no foreign body response.

At 21 days the degree of number of blood vessels per unit area within the ECF treated wounds ($0.50\pm0.09$) was lower than in the untreated wounds ($0.34\pm0.03$) ($p<0.001$). Also, the matrix density within the wound was significantly closer to the matrix density of the adjacent tissue ($p=0.038$) in the ECF treated wounds with a difference of $23.1\pm8.5$ compared with the untreated controls at $33.9\pm5.1$. Although there was not statistical difference ($p>0.5$) for the rete pegs parameter, it did appear that at the edges of the treated wounds there were some rete pegs while there were none in the controls.

Although the foregoing invention has been described in some detail by way of illustration and example for purposes of clarity and understanding, it will be obvious to one of skill in the art that certain changes and modifications may be practiced within the scope of the appended claims.

What is claimed is:

1. A method for producing and concentrating strands comprising: (i) extruding a material from an orifice submerged in a flow of coagulation agent that shears off strands of the material and solidifies the material in that form, and (ii) concentrating the strands, wherein the material is selected from the group consisting of collagen, hyaluronic acid, mixtures of collagen and hyaluronic acid, poly-glycolic acid, and poly-lactic acid, wherein the coagulation agent comprises a dehydrating agent that is selected from the group consisting of dextran, polyethylene glycol, isopropyl alcohol and acetone, and wherein concentrating the strands comprises forcing a dilute solution of strands back and forth in an alternating matter, through the lumen of a tangential flow filter whereby transluminal effluent passes through the filter resulting in a more concentrated solution of strands.

2. The method of claim 1, wherein the material being extruded comprises collagen in solution.

3. A method for producing and concentrating strands comprising: (i) extruding a material from an orifice submerged in a flow of coagulation agent that shears off strands of the material and solidifies the material in that form, and (ii) concentrating the strands, wherein the material is selected from the group consisting of collagen, hyaluronic acid, mixtures of collagen and hyaluronic acid, poly-glycolic acid, and poly-lactic acid, wherein the coagulation agent comprises a dehydrating agent that is selected from the group consisting of dextran, polyethylene glycol, isopropyl alcohol and acetone, and wherein concentrating the strands comprises drying a dilute solution of strands and reconstituting the dried strands with the appropriate fluid volume.

4. A method for producing and concentrating strands comprising: (i) extruding a material from an orifice submerged in a flow of coagulation agent that shears off strands of the material and solidifies the material in that form, and (ii) concentrating the strands, wherein the material is selected from the group consisting of collagen, hyaluronic acid, mixtures of collagen and hyaluronic acid, poly-glycolic acid, and poly-lactic acid, wherein the coagulation agent comprises a dehydrating agent that is selected from the group consisting of dextran, polyethylene glycol, isopropyl alcohol and acetone, and wherein concentrating the strands comprises compacting a dilute solution of strands between porous filters.

5. A method for producing and concentrating strands comprising: (i) extruding a material from an orifice submerged in a flow of coagulation agent that shears off strands of the material and solidifies the material in that form, and (ii) concentrating the strands, wherein the material is selected from the group consisting of collagen, hyaluronic acid, mixtures of collagen and hyaluronic acid, poly-glycolic acid, and poly-lactic acid, wherein the coagulation agent comprises a dehydrating agent that is selected from the group consisting of dextran, polyethylene glycol, isopropyl alcohol and acetone, and wherein concentrating the strands comprises filling a solid porous mold with a dilute solution of strands.

6. A method for producing strands comprising (i) extruding a material through a first orifice in a gaseous environment to form droplets that drip into a coagulation agent and (ii) passing the droplets through a second orifice in the coagulation agent that elongates the droplets into strands which are solidified in that form, wherein the material is selected from the group consisting of collagen, hyaluronic acid, mixtures of collagen and hyaluronic acid, poly-glycolic acid, and poly-lactic acid, wherein the coagulation agent comprises a dehydrating agent that is selected from the group consisting of dextran, polyethylene glycol, isopropyl alcohol and acetone, and wherein the strands are filtered from the coagulation agent.

7. The method of claim 6, wherein the filtered strands are concentrated.

8. A method for producing and concentrating strands comprising (i) extruding a material through a first orifice in a gaseous environment to form droplets that drip into a coagulation agent, (ii) passing the droplets through a second orifice in the coagulation agent that elongates the droplets into strands which are solidified in that form, and (iii) concentrating the strands, wherein the material is selected from the group consisting of collagen, hyaluronic acid, mixtures of collagen and hyaluronic acid, poly-glycolic acid, and poly-lactic acid, wherein the coagulation agent comprises a dehydrating agent that is selected from the group consisting of dextran, polyethylene glycol, isopropyl alcohol and acetone, and wherein the strands are filtered from the coagulation agent.

9. The method of claim 8, wherein the material being extruded comprises collagen in solution.

10. The method of claim 8, wherein concentrating the strands comprises forcing a dilute solution of strands back and forth in an alternating matter, through the lumen of a tangential flow filter whereby transluminal effluent passes through the filter resulting in a more concentrated solution of strands.

11. The method of claim 10, wherein the material being extruded comprises collagen in solution.

12. The method of claim 8, wherein concentrating the strands comprises drying a dilute solution of strands and reconstituting the strands with the appropriate fluid volume.

13. The method of claim 8, wherein concentrating the strands comprises compacting a dilute solution of strands between porous filters.

14. The method of claim 8, wherein concentrating the strands comprises filling solid or mesh porous molds with a dilute solution of strands.

15. The method of claim 8, wherein concentrating the strands comprises partially desiccating a dilute solution of strands by placing it in contact with porous materials.

* * * * *